US008673831B2

(12) United States Patent
Kitching et al.

(10) Patent No.: US 8,673,831 B2
(45) Date of Patent: Mar. 18, 2014

(54) ENGINE LUBRICANTS

(75) Inventors: Jane Kitching, Cleveland (GB); Steven James Randles, Cleveland (GB); Stephen Boyde, Cleveland (GB); Josephine Lefevre, Cleveland (GB)

(73) Assignee: Croda International PLC, Goole, East Yorkshire (GB)

( * ) Notice: Subject to any disclaimer, the term of this patent is extended or adjusted under 35 U.S.C. 154(b) by 288 days.

(21) Appl. No.: 12/736,617

(22) PCT Filed: Apr. 17, 2009

(86) PCT No.: PCT/GB2009/000999
§ 371 (c)(1),
(2), (4) Date: Oct. 22, 2010

(87) PCT Pub. No.: WO2009/130445
PCT Pub. Date: Oct. 29, 2009

(65) Prior Publication Data

US 2011/0039740 A1 Feb. 17, 2011

(30) Foreign Application Priority Data

Apr. 23, 2008 (GB) ..... 0807372.8

(51) Int. Cl.
*C10L 1/14* (2006.01)

(52) U.S. Cl.
USPC ..... 508/459

(58) Field of Classification Search
USPC ..... 508/459
See application file for complete search history.

(56) References Cited

U.S. PATENT DOCUMENTS

| | | | | |
|---|---|---|---|---|
| 2,757,139 | A | 7/1956 | Matzuszak et al. | |
| 4,155,861 | A * | 5/1979 | Schmitt et al. | 508/492 |
| 6,303,548 | B2 * | 10/2001 | Gao | 508/469 |
| 6,667,285 | B1 * | 12/2003 | Kawahara et al. | 508/485 |
| 2004/0198614 | A1 | 10/2004 | Calder | |

FOREIGN PATENT DOCUMENTS

| | | |
|---|---|---|
| EP | 0792334 | 9/1997 |
| JP | 63-205394 | 8/1988 |

OTHER PUBLICATIONS

International Search Report dated Sep. 17, 2009 for PCT/GB2009/000999.
Examination Report dated Oct. 9, 2012 for corresponding Chinese Application No. 200980114333.4 (with English translation).

* cited by examiner

*Primary Examiner* — Prem C Singh
*Assistant Examiner* — Francis C Campanell
(74) *Attorney, Agent, or Firm* — Jones Day

(57) ABSTRACT

An engine lubricant, especially an SAE OW engine lubricant is described. The engine lubricant has at least 15 wt % of at least one monoester and not more than 15 wt % of additives, wherein said at least one monoester, or mixture of said monoesters if more than one is present, has a kinematic viscosity at 100° C. of not more than 3.3, a viscosity index of at least 130 and a Noack evaporation loss of not more than 15 wt %. The monoester is preferably the reaction product of a monohydric alcohol and a monocarboxylic acid wherein said monohydric alcohol is at least one saturated branched-chain aliphatic monohydric alcohol having between 16 and 36, carbon atoms and wherein said monocarboxylic acid is at least one saturated straight-chain aliphatic monocarboxylic acid having between 5 and 10, preferably 5 and 7, carbon atoms. In preferred lubricants, the monoester, or mixtures of monoesters, have a pour point of not more than −30° C. and a non-polarity index of at least 80.

30 Claims, No Drawings

ENGINE LUBRICANTS

CROSS REFERENCE TO RELATED APPLICATION

This application is the National Phase application of International Application No. PCT/GB2009/000999, filed 17 Apr. 2009, which designates the United States and was published in English. This application, in its entirety, is incorporated herein by reference.

The present invention relates to engine lubricants, particularly to engine lubricants as used in four-stroke engines, and more especially to engine lubricants having an SAE class rating of less than SAE 5W; and to the use of such lubricants in four-stroke engines.

Owing to the ever increasing environmental, legislative and economic pressures, engine lubricants are required that contribute to increased engine efficiency, ie greater mpg or kpl and lowered engine emissions, and decreased frequency between lubricant changes, ie less oil usage.

However, these requirements are difficult to meet, especially when using petroleum-based oils, eg mineral oils, as lubricants, as they impose conflicting requirements on the viscosity and volatility properties exhibited by such oils. For example, engine oils are required to allow easy cold engine starting at low ambient temperatures whilst ensuring good lubrication at high operating temperatures. This may be achieved by blending lubricant stocks of different viscosities. However, such formulations may not be sufficient to meet the operating temperature range requirements owing to disparate viscosity indices of the component lubricant stocks. This has led to the use of viscosity index improvers, often in relatively high amounts. Such viscosity index improvers are frequently polymeric in nature and may be broken down by the operating temperatures and shearing of the fluid in the engines, especially in high performance vehicles, leading to potential loss in viscosity and engine failure.

Other approaches use synthetic lubricant stocks such as specially processed mineral oils, α-olefin oligomers and polymers (hereinafter poly-α-olefins) and esters including monoesters, diesters, polyol esters and complex esters, with or without appropriate additives such as viscosity index improvers.

Such approaches are exemplified in, for example, DE Offenlegungsschrift 2133042, EP-A-0089709, EP-B-0792334, JP 1993331483A, U.S. Pat. No. 4,155,861 and U.S. Pat. No. 6,303,548B2.

DE OL 2133042 discloses an engine lubricant of viscosity class 10W-20 to 5W-20 which consists of a mineral oil raffinate having a viscosity index of between 80 and 105 and a kinematic viscosity at 100° C. of between 7.5 cSt and 12 cSt, an oil-soluble synthetic lubricating oil, such as a diester, having a kinematic viscosity at 100° C. of between 3 cSt and 5 cSt and a Noack evaporation loss of between 3 and 10% and additives. A specific example of a 10W engine oil having a kinematic viscosity at 100° C. of 7 cSt and a viscosity index of 116 and has a 5% additive packages is derived from 75% mineral oil having a kinematic viscosity at 100° C. of 9 cSt, a viscosity index of 102 and a Noack evaporation loss of 6% and 25% di-n-decanol trimethyl adipate.

EP-A-0089709 discloses organic carbonic acid diesters derived from alcohols as components in engine lubricants.

EP-B-0792334 discloses an engine lubricant having at least one ester derived from a saturated branched chain aliphatic monohydric alcohol having at least 8 carbon atoms and a saturated branched chain aliphatic monocarboxylic acid having at least 10 carbon atoms.

JP 1993331483A discloses an engine oil in which reduced amounts of viscosity index improvers are required. The engine oil has 10% to 30% of a diester or polyol ester, 60% to 89% of an α-olefin oligomer, 1% to 20% of an ethylene α-olefin oligomer and 0.5% to 3% zinc dialkyl dithiophosphate as an anti-wear agent. The oil has a kinematic viscosity at 100° C. of 4 cSt or greater. A specific example incorporates di-isodecyl adipate which has a kinematic viscosity at 100° C. of 3.62 cSt.

U.S. Pat. No. 4,155,861 discloses lubricating oils based on mixed esters consisting of a monomeric diester of a dicarboxylic acid and a complex ester derived from a dicarboxylic acid (preferably branched) and hexanediol or trimethyl hexanediol. In the specific examples, the monomeric diester is n-octyl, n-decyl trimethyl adipate. The addition of the complex ester at levels of 1% to 10% to the n-octyl, n-decyl trimethyl adipate is said to result in engine oils in the SAE classes 5W/20, 5W/30 or 10W/40.

U.S. Pat. No. 6,303,548B2 discloses an SAE 0W-40 lubricant composition consisting of 5% to 80% of a mineral oil base stock, 5% to 90% of a poly-α-olefin which has a kinematic viscosity at 100° C. in the range 3.5 cSt to 4.5 cSt and 1% to 30% of an ester derived from monocarboxylic acids and polycarboxylic acids with monohydroxyl alcohols and polyols together with a viscosity improver comprising a mixture of 3% to 7% of a polymethacrylate and 4% to 9% olefin copolymer or hydrogenated diene copolymer. A specific example uses di-isooctyl adipate.

Other examples of lubricants are disclosed in U.S. Pat. No. 5,286,397 and WO 2007/082639 A.

U.S. Pat. No. 5,286,397 discloses a low-viscosity lubricant composition obtained from the esterification of a $C_8$ or $C_9$ aliphatic dicarboxylic acid and a $C_{12}$ to $C_{20}$ Guerbet alcohol. The esters exemplified in U.S. Pat. No. 5,286,397 have a kinematic viscosity at 100° C. greater than 3.4.

WO 2007/082639 A discloses lubricants based on esters derived from the esterification of an alcohol of formula $R^1OH$ wherein $R^1$ is a branched $C_{10}$ to $C_{40}$ alkyl radical with a dicarboxylic acid of formula $HOOCR^2COOH$ wherein $R^2$ is a branched or linear $C_0$ to $C_{34}$ alkyl radical or with a monocarboxylic acid of formula $R^3COOH$ wherein $R^3$ is a branched $C_3$ to $C_{39}$ alkyl radical or with a monocarboxylic acid of formula $R^3COOH$ wherein $R^3$ is a linear $C_3$ to $C_{29}$ alkyl radical or with mixtures of at least two such acids.

Some disadvantages of such lubricants include the inherent limitation imposed by the viscosity indices of the base oils (which impacts film thickness); and the inability to reduce viscosity without increasing volatility (ie increasing the Noack evaporation loss of the lubricant). Additionally, very low viscosity esters can also have high polarity which can lead to seal compatibility issues and potential wear issues due to competition with antiwear agents such as ZDDP when the esters are used at high dose rates, eg >15 wt %. For example, di-isooctyl adipate has a non-polarity index (NPI), as described in EP-B-0792334, of 41. In addition, low viscosity lubricants, which have been optimised to give low volatilities, can also suffer from either low viscosity indices (<125), poor low temperature flow properties or shorter drain intervals resulting from poor oxidative stability (from the use of components in which gem dimethyl branching is present).

Although, as described, environmental, legislative and economic pressures are driving the development of engine lubricants that contribute to increased engine efficiency etc, in other areas such requirements may not apply. For example, there are increasing pressures to enhance the power outputs from high performance racing engines, ie in F1 car racing, as racing regulations are introduced which limit technical innovation in relation to such engines and cars. Such improvements in power output have to be sought through innovative solutions involving lubricants and/or fuels.

It is an object of the present invention to provide an engine lubricant which is particularly useful for use in four-stroke engines, both for use in convention vehicles and for use in high performance applications. It is a further object of the present invention to provide an engine lubricant which has an SAE class rating of less than 5W, more especially an SAE class rating of 0W.

According to the present invention, an engine lubricant comprises at least 15 wt % of at least one monoester and not more than 20 wt % of additives, wherein said at least one monoester, or mixture of said monoesters if more than one is present, has a kinematic viscosity at 100° C. of not more than 3.3, a viscosity index of at least 130 and a Noack evaporation loss of not more than 15 wt %.

As used in this specification in relation to the invention described and claimed, as required by the context, the term "wt %" indicates the percentage by weight of the component referred to as a percentage of the total weight of the engine lubricant. Where the context refers to a specific component, for example a Noack evaporation loss, the term "wt %" indicates the percentage by weight of the total weight of the component.

The engine lubricant is particularly useful for four stroke engines in high performance applications. Preferably, said engine lubricant comprises up to 90 wt % of said at least one monoester. In one embodiment of the invention, said engine oil consists essentially of said at least one monoester and said additives.

The engine lubricant is particularly useful for four stroke engines in conventional vehicles. Preferably, said engine lubricant comprises at least 20 wt %, more preferably at least 25 wt % of said at least one monoester. Said engine lubricant may comprise up to 75 wt %, more preferably up to 50 wt %, and, more especially up to 40 wt % of said at least one monoester. In one embodiment of the invention, said engine lubricant comprises about 30 wt % of said at least one monoester.

Preferably, said at least one monoester is the reaction product of a monohydric alcohol and a monocarboxylic acid wherein said monohydric alcohol is at least one saturated branched-chain aliphatic monohydric alcohol having between 16 and 36 carbon atoms and wherein said monocarboxylic acid is at least one saturated straight-chain aliphatic monocarboxylic acid having between 5 and 10, preferably between 5 and 7 carbon atoms. If desired, mixtures of said alcohols and/or said acids may be used in the esterification reaction.

Alternatively, said at least one monoester is the reaction product of a monohydric alcohol and a monocarboxylic acid wherein said monohydric alcohol is at least one saturated straight-chain aliphatic monohydric alcohol having between 5 and 7 carbon atoms and wherein said monocarboxylic acid is at least one saturated branched-chain aliphatic monocarboxylic acid having between 16 and 36 carbon atoms. If desired, mixtures of said alcohols and/or said acids may be used in the esterification reaction.

Mixtures of the monoesters described in the preceding two paragraphs may also be used.

However, it is preferred that the monoesters used in the present invention are monoesters which are the reaction products of said branched-chain alcohols having between 16 and 36 carbon atoms and said straight-chain acids having between 5 and 10, preferably between 5 and 7, carbon atoms as described above.

The branched-chain monohydric alcohol may be obtained from any suitable source and typically may be selected from Guerbet alcohols, oxo alcohols, aldol condensation derived alcohols and mixtures thereof.

More especially, the branched-chain monohydric alcohol is an alcohol branched at the β position on the main carbon chain. Typically, such alcohols may be selected from, 2-octadecanol-1 (also known as 2-octyldecanol-1), 2-heptylundecanol-1, 2-octadodecanol-1 (also known as 2-octyldodecanol-1), 2-nonyltridecanol-1 and 2-decyltetradecanol-1 and mixtures of two or more such alcohols. Such alcohols are conveniently Guerbet alcohols.

Preferably, the branched-chain monohydric alcohol is at least one alcohol having between 16 and 28 carbon atoms, more preferably between 20 and 24 carbon atoms.

The straight-chain monocarboxylic acid may be obtained from any suitable source and is selected from pentanoic acid (valeric acid), hexanoic acid (caproic acid), heptanoic acid (enanthic acid), octanoic acid (caprylic acid), decanoic acid (capric acid) and mixtures of two or more such acids.

As will be appreciated, the acids and alcohols used to make said monoesters used in the present invention will be from commercial sources and may not necessarily comprise 100 wt % of the acid or alcohol component under consideration. Such commercial products usually comprise a major proportion of the primary product together with other isomers and/or additional products of shorter or longer chain length. This may lead to variations in properties of the monoesters which are reaction products of the esterification reactions.

Preferably, said at least one monoester has a kinematic viscosity at 100° C. of not more than 3.0 cSt. Preferably, said at least one monoester has a viscosity index of at least 140. Preferably, said at least one monoester has a pour point of not more than −30° C., more particularly of not more than −35° C. and especially not more than −40° C. Preferably, said at least one monoester has a Noack evaporation loss of not more than 14.5 wt %, more preferably of not more than 14.0 wt %.

Preferably, said at least one monoester has a flash point of at least 200° C., more preferably at least 210° C. and more particularly at least 220° C.

Preferably, said at least one monoester has a non-polarity index (NPI), as described in EP-B-0792334, of at least 80, preferably of at least 90.

Preferably, said at least one monoester is stable when held at −20° C. for one week. This low temperature stability may be tested by storing approximately 30 ml of monoester in a glass vial and placing the vial in a freezer unit at −20° C. for one week, checking the sample at regular intervals and noting any signs of crystal formation or gelling.

Preferably, said at least one monoester has a cold crank simulation (CCS) dynamic viscosity at −35° C. of not more than 6200 cPs.

When said engine lubricant does not consist essentially of said at least one monoester and said additives, the balance of said engine lubricant comprises lubricant components selected from API Groups III, III+ (including gas-to-liquids (GTL)), IV, IV+ and V lubricants and mixtures of two or more thereof. Examples of suitable Group III lubricants include mineral oils. Examples of suitable Group IV lubricants included poly-α-olefins derived from $C_8$ to $C_{12}$ α-olefins and having kinematic viscosities in the range 3.6 cSt to 8 cSt at 100° C. Examples of Group V lubricants include alkyl naphthalenes, alkyl benzenes and esters, for example esters derived from monohydric alcohols and/or polyols and monocarboxylic acids or polycarboxylic acids. The ester may be a monoester which is different from said at least one monoester, a polyol ester or a complex ester. Preferably the ester is a monoester which is different from said at least one monoester. Preferably the monoester which is different from said at least one monoester has a kinematic viscosity at 100° C. of between 4 and 6 cSt. Preferably the monoester which is different from said at least one monoester has an NPI of at least 130. Preferably the monoester which is different from said at least one monoester has a Noack evaporation loss of not more than 10%, preferably not more than 7%, especially not more than 5%. Preferably the monoester which is different from said at least one monoester is the reaction product of a monohydric alcohol and a monocaboxylic acid wherein said monohydric alcohol is at least one saturated branched-chain aliphatic monohydric alcohol having between 16 and 36 carbon atoms and wherein said monocarboxylic acid is at least one saturated branched-chain aliphatic monocarboxylic acid having at least 10 carbon atoms. If desired, mixtures of said alcohols and/or acids may be used in the esterification process. Alternatively, the monoester which is different from said at least one monoester is the reaction product of a monohydric alcohol and a monocarboxylic acid wherein said monohydric alcohol is at least one saturated branched-chain aliphatic monohydric alcohol having at least 10 carbon atoms and wherein said monocarboxylic acid is at least one saturated branched-chain aliphatic monocarboxylic acid having between 16 and 36 carbon atoms. If desired, mixtures of said alcohols and/or said acids may be used in the esterification reaction.

However, it is preferred that the monoester which is different from said at least one monoester used in the present invention is a monoester which is the reaction products of said saturated branched-chain alcohols having between 16 and 36 carbon atoms and said saturated straight-chain acids having at least 10 carbon atoms as described above.

Preferably, the branched-chain monohydric alcohol is at least one alcohol having between 16 and 28 carbon atoms, more preferably between 20 and 24 carbon atoms.

The branched-chain monohydric alcohol may be obtained from any suitable source and typically may be selected from Guerbet alcohols, oxo alcohols, aldol condensation derived alcohols and mixtures thereof.

More especially, the branched-chain monohydric alcohol is an alcohol branched at the β position on the main carbon chain. Typically, such alcohols may be selected from, 2-octadecanol-1 (also known as 2-octyldecanol-1), 2-heptylundecanol-1, 2-octadodecanol-1 (also known as 2-octyldodecanol-1), 2-nonyltridecanol-1 and 2-decyltetradecanol-1 and mixtures of two or more such alcohols. Such alcohols are conveniently Guerbet alcohols.

The saturated branched-chain monocarboxylic acid having at least 10 carbon atoms may be branched in any position and sometimes branching occurs at several positions in the carbon chain. The branched cahin acids may be produced by alkali fusion of alcohols, by oxidation of aldehydes or Guerbet alcohols, by carboxylation of olefins (Koch-Haag synthesis; Reppe process) or by paraffin oxidation, or any other suitable method. Also the acids obtained by reaction of alpha-olefins with fatty acids may be used. Preferably the saturated branched-chain monocarboxylic acid has at least 12 carbon atoms, more preferably at least 14 carbon atoms and especially at least 16 carbon atoms. Examples of suitable acids are iso-stearic acid, iso-palmitic acid, iso-decanoic acid, Neo acids, ceKanoic acids and mixtures of two or more such acids.

Preferably, the weight ratio of said at least one monoester to said at least one monoester which is different to said at least one monoester as described is between 100:0 to 20:80, more preferably between 100:0 to 30:70, and more particularly between 100:0 and 35:65.

Examples of alkyl naphthalenes include Synesstic™ 5 and Synesstic™ 12 alkyl naphthalenes available from Mobil. Examples of esters include Priolube™ 1976 a monoester and Priolube™ 3970 a trimethylolpropane (TMP) $nC_8/nC_{10}$ polyol ester, both available from Croda Europe Ltd. GTL base stocks are made by conversion of natural gas (ie, methane and higher alkanes) to synthesis gas (carbon monoxide and hydrogen) and then via oligomerisation (eg the Fischer-Tropsch process) to higher molecular weight molecules that are hydrocracked to produce iso-paraffins in the required lubricant boiling/viscosity range. GTL base stocks are only just being commercialised and consequently there is little or no data relating to them that is freely available. As far as it is known, such GTL base stocks will have viscosity grades similar to poly-α-olefins.

In one embodiment of the invention, said engine lubricant consists essentially of said at least one monoester, at least one Group V lubricant, especially an alkyl naphthalene or an ester other than said at least one monoester such as a polyol ester or complex ester or a different monoester from said at least one monoester, and said additives.

In a further embodiment of the invention, said engine lubricant consists essentially of said at least one monoester, at least one Group V lubricant, especially an alkyl naphthalene or an ester other than said at least one monoester such as a polyol ester or complex ester or a different monoester from said at least one monoester, at least one Group IV lubricant and said additives.

Preferably, said engine lubricant comprises only one of said at least one monoester.

Where said engine lubricant comprises at least two of said at least one monoester, each monoester may be selected with different properties. Preferably, the properties of each monoester are within the values of such properties as described above; alternatively, one or more of the properties of at least one monoester may be outside the values of such properties as described above provided that the properties of the mixture of monoester are within the values of such properties as described above.

In one embodiment of the present invention, said engine lubricant comprises, in addition to said at least one monoester and said additives, at least one diester as described in PCT/GB2008/000599 which is incorporated herein by reference in its entirety. As described in said PCT/GB2008/000599 said at least one diester, or mixture of said diesters if more than one is present, has a kinematic viscosity at 100° C. of not more than 3.3, a viscosity index of at least 130, a pour point of not more than −30° C. and a Noack evaporation loss of not more than 15 wt %.

Preferably, the weight ratio of said at least one monoester to said at least one diester as described in PCT/GB2008/000599 is between 100:0 to 30:70, more preferably between 100:0 to 50:50, and more particularly between 95:5 and 70:30.

As is described in said PCT/GB2008/000599, preferably, said at least one diester has a kinematic viscosity at 100° C. of not more than 3.0 cSt. Preferably, said at least one diester has a viscosity index of at least 140. Preferably, said at least one diester has a pour point of not more than about −30° C., more particularly of not more than −35° C. and especially not more than −40° C. Preferably, said at least one diester has a Noack evaporation loss of not more than 14.5 wt %, more preferably of not more than 14.0 wt %.

Preferably, said at least one diester has a flash point of at least 200° C., more preferably at least 210° C., more particularly at least 220° C. and especially of about 230° C.

Preferably, said at least one diester has an NPI of more than 30 but less than 100, more preferably less than 80.

Preferably, said at least one diester is stable when held at −20° C. for one week.

Preferably, said at least one diester has a cold crank simulation (CCS) dynamic viscosity at −35° C. of not more than 6200 cPs.

Where said engine lubricant comprises at least two of said at least one diester as described in said PCT/GB2008/000599, each diester may be selected with different properties. Preferably, the properties of each diester are within the values of such properties as described above; alternatively, one or more of the properties of at least one diester may be outside the values of such properties as described above provided that the properties of the mixture of diesters are within the values of such properties as described above.

Preferably, said at least one diester is selected from the group consisting of:

a) reaction products of at least one $C_5$ to $C_{12}$, preferably $C_6$ to $C_{10}$, aliphatic dicarboxylic acid or an anhydride thereof with at least one primary or secondary, preferably primary, $C_7$ to $C_{12}$, preferably $C_8$ to $C_{10}$, aliphatic monohydric alcohol, wherein, if said at least one acid is branched, then at least one of said at least one alcohol is linear and, if said at least one acid is linear, then at least one of said at least one alcohol is branched; and b) reaction products of at least one $C_5$ to $C_{12}$, preferably $C_6$ to $C_{10}$, aliphatic monocarboxylic acid with at least one polyalkylene glycol wherein the alkyl group is selected from $C_2$ to $C_4$ alkyl groups and mixtures thereof, and wherein, if said at least one poly(alkylene glycol) contains at least one repeat unit that is branched methyl group, then at least one of said at least one acid is linear and, if said at least one poly(alkylene glycol) contains only linear repeat units, then at least one of said at least one acid is branched.

Preferably, the diester, when derived from diacids or anhydrides thereof and monohydric alcohols, contains 17 to 36, more particularly 20 to 30 and especially 23 to 26 carbon atoms.

Preferably, the diester, when derived from monoacids and poly(alkylene glycols), contains 17 to 40, more particularly 20 to 30 carbon atoms.

Preferably, the reaction products of dicarboxylic acids and alcohols are reaction products of either branched acids with linear alcohols or linear acids with branched alcohols.

Preferably, the reaction products of monocarboxylic acids with poly(alkylene glycols) are reaction products of either branched acids with poly(ethylene glycol) or linear acids with poly(propylene glycol) or poly(butylene glycol), preferably poly(propylene glycol), or copolymers thereof containing at least one ethylene glycol repeat unit. Preferably, the poly (alkylene glycol) has an average relative molecular mass (avRMM) about in the range 150 to 300, more particularly about in the range 180 to 250. Preferred poly(alkylene glycols) are poly(propylene glycols).

The branched chains of the branched acids and/or branched alcohols may be $C_1$ to $C_4$ alkyl, more preferably $C_1$ or $C_2$ alkyl and especially methyl. The branched acids are preferably not branched in the α-position but are preferably branched in the β-position. Preferably, the acids do not contain any gem branched groups, eg gem dimethyl or gem diethyl, and preferably contain only one or two branches, especially a single branch in the β-position.

Preferred dicarboxylic acids include adipic acid, 3-methyl adipic acid and sebacic acid. Preferred primary alcohols include 1-octanol, 1-decanol and mixtures thereof, 2-ethylhexanol and isononyl alcohol. Preferred monocarboxylic acids include caprylic and capric acids. Preferred poly(alkylene glycols) consist of poly(propylene glycols), preferably having an av RMM between 180 and 250.

Preferred diesters as described in PCT/GB2008/000599 are selected from the group consisting of di-isononyl adipate, di-n-octyl 3-methyl-adipate, di-2-ethylhexyl sebacate and PPG 225 n-octyl, n-decyl diester and mixtures thereof. More particularly, the diesters are selected from the group consisting of di-isononyl adipate, di-n-octyl 3-methyl-adipate and di-2-ethylhexyl sebacate and mixtures thereof.

As will be appreciated, the acids and alcohols used to make said diesters as described in PCT/GB2008/000599 will be from commercial sources and may not necessarily comprise 100 wt % of the acid or alcohol component under consideration. Such commercial products usually comprise a major proportion of the primary product together with other isomers and/or additional products of shorter or longer chain length. This may lead to variations in properties of the diesters which are reaction products of the esterification reactions.

In one embodiment of the present invention, said engine lubricant consists essentially of said at least one monoester, said at least one diester and said additives.

In another embodiment of the present invention, said engine lubricant consists essentially of said at least one monoester, said at least one diester and at least one Group V lubricant, especially an alkyl naphthalene or an ester other than said at least one monoester or said at least one diester such as a polyol ester or complex ester or said monoester which is different to said at least one monoester, and said additives.

In one embodiment of the invention, said engine lubricant optionally may comprise esters selected from simple esters not being monoesters as hereinbefore described, diesters, not being diesters as described in said PCT/GB2008/000599, and complex esters or mixtures thereof. Preferably, the weight ratio of said monoesters to said optional esters will be between 100:0 to 60:40, more preferably between 100:0 to 75:25, more particularly between 99:1 and 80:20 and, especially between 95:5 to 85:15.

As previously described, said engine lubricant of the present invention comprises not more than 20 wt % of additives. Preferably, said engine lubricant comprises not more than 15 wt % of additives, more especially not more than 10 wt % of additives.

Typically, said additives are:

a) viscosity index improvers, for example alkyl methacrylate copolymers, olefin copolymers (OCP) and mixtures thereof, which are added in effective amounts, typically in the range 0.1 wt % to 6 wt %;

b) antioxidants, for example phenolic antioxidants, such as hindered phenols, and alkylated diphenyl amines and mixtures thereof, which are added in effective amounts, typically in the range 0.5 wt % to 1 wt %;

c) metal deactivators, for example metal dialkyldithiophosphates, thiadiazoles and triazoles (which may also function as corrosion inhibitors and extreme pressure additives), which are added in effective amounts, typically in the range 0.01 wt % to 0.5 wt %;

d) pour point depressants which are added in effective amounts, typically in the range 0.1 wt % to 1.0 wt %;

e) extreme pressure additives, for example zinc diaryl dithiophosphates (ZDDP), which are added in effective amounts, typically in the range 0.5 wt % to 3.0 wt %;

f) friction modifiers, for example glycerol mono-oleate, which are added in effective amounts, typically in the range 0.3 wt % to 1.3 wt %;

g) anti-foam agents, for example dimethyl polysiloxane, polyacrylate, which are added in effective amounts, typically in the range 1 ppm to 100 ppm;

h) multifunctional additives such as DDI (detergent-dispersion-inhibitor) packages;

i) and mixtures of two or more such additives.

In engine lubricants according to the invention in which said monoesters and, optionally, other esters are present in significant quantities, preferably as a major component of the engine lubricants, such engine lubricants may be free of some additives such as viscosity index improvers.

The combinations of additives used in engine lubricants and the amounts thereof may vary significantly; however, the total amount of all additives included in said engine lubricant according to the invention is subject to the upper limits of 20 wt %, more preferably 15 wt % and more especially 10 wt %, as previously described.

The present invention includes the use of said engine lubricant as herein described in lubricating four-stroke engines and a method of lubricating a four-stroke engine comprising lubricating said engine with said engine lubricant as herein described.

The present invention further includes an SAE 0W engine lubricant, said engine lubricant comprising at least one monoester as herein described. The features and embodiments herein described apply also mutatis mutandis to said SAE 0W engine lubricant.

The invention will now be further illustrated with reference to the following Example.

EXAMPLE

Samples 1 to 4 as identified in Table 1 below are monoesters suitable for use in said engine lubricants according to the invention. The properties of the samples are given in Table 3.

Samples 5 to 9 as identified in Table 2 below are diesters suitable for use in combination with the monoesters comprising said engine lubricants according to the invention. The properties of the Samples 5 to 9 are given in Table 3.

Sample 10 as identified in Table 2 below is a monoester different to said at least one monoester for use in combination with the monoesters comprising said engine lubricants according to the invention. The properties of Sample 10 are given in Table 3.

TABLE 1

| Sample | Linear Acid | Branched Alcohol |
|---|---|---|
| 1 | Pentanoic | 2-octyldodecanol-1 |
| 2 | Heptanoic | 2-octyldodecanol-1 |
| 3 | Caprylic | 2-octyldodecanol-1 |
| 4 | Caprylic/Capric (approximately 50:50 by wt mixture) | 2-octyldodecanol-1 |

TABLE 2

| Sample | Linear Acid | Branched Acid | Linear Alcohol | Branched Alcohol | Poly (alkyl glycol) |
|---|---|---|---|---|---|
| 5 | Adipic | — | — | Isononyl* | — |
| 6 | Adipic | — | — | Isononyl** | — |
| 7 | — | 3-methyl adipic | 1-octanol | — | — |
| 8 | Sebacic | — | — | 2-ethylhexanol | — |
| 9 | Caprylic/capric (approximately 50:50 mixture) | — | — | — | PPG 225 |
| 10 | | Iso-stearic | | 2-octyldodecanol-1 | |

*Commercially-sourced isononyl alcohol comprising <85 wt % isononyl alcohol.

**Commercially-sourced isononyl alcohol comprising at least 85 wt % isononyl alcohol.

TABLE 3

| Sample | Viscosity @ 40° C. (cSt) | Viscosity @ 100° C. (cSt) | Viscosity Index | Flash Point (° C.) | Pour Point (° C.) | Noack Evaporation Loss (wt %) | Stability at −20° C. for 1 week | NPI | CCS −35° C. (cPs) |
|---|---|---|---|---|---|---|---|---|---|
| Monoesters | | | | | | | | | |
| 1 | 8.3 | 2.7 | 186 | 207 | −59 | 15 | Pass | 96 | <500 |
| 2 | 9.7 | 2.9 | 159 | 220 | −47 | 10 | Pass | 111 | <500 |
| 3 | 10.5 | 2.94 | 138 | 230 | −28 | 12 | Pass | 119 | <500 |
| 4 | 11.2 | 3.1 | 144 | 241 | −19 | 10 | Pass | 127 | <500 |
| Diesters | | | | | | | | | |
| 5 | 12.0 | 3.3 | 156 | 210 | −60 | 12 | Pass | 48 | <500 |
| 6 | 10.5 | 3.0 | 159 | 230 | −50 | 13 | Pass | 48 | <500 |
| 7 | 8.9 | 2.8 | 169 | 229 | −36** | 14 | Pass | 47 | <500 |
| 8 | 11.5 | 3.3 | 157 | 230 | <−60 | 12 | Pass | 55 | <500 |
| 9 | 10.6 | 3.0 | 149 | 228 | −62 | 14 | Pass | <61 | <500 |
| Different Monoester | | | | | | | | | |
| 10 | 25.3 | 5.5 | 163 | 260 | −35 | 3 | Pass | 215 | |

**Precipitate started to form at about −36° C. and continued to build up. At −48° C., the sample still had a liquid layer that was fluid.

The monoesters of the invention have properties as disclosed in Table 3. These monoesters have low viscosity in combination with low volatility and therefore will exhibit low viscous drag which will lead to enhanced fuel efficiency. Also the polarity of these monoesters is acceptable which will avoid seal compatibility issues and potential wear issues from competition with antiwear agents. Furthermore the monoesters have high viscosity indices.

The invention claimed is:

1. An SAE 0W engine lubricant comprising at least 15 wt % of at least one monoester and not more than 20 wt % of additives;

wherein:

i) the at least one monoester comprises the reaction product of:

a) at least one $C_{16-36}$ saturated branched-chain aliphatic monohydric alcohol; and b) at least one $C_{5-10}$ saturated straight-chain aliphatic monocarboxylic acid; and ii) said at least one monoester, or mixture of said at least one monoesters if more than one is present, has a kinematic viscosity at 100° C. of not more than 3.3, a viscosity index of at least 130 and a Noack evaporation loss of not more than 15 wt %.

2. The engine lubricant of claim 1, wherein the engine lubricant comprises up to 90 wt % of said at least one monoester.

3. The engine lubricant of claim 1, wherein the engine lubricant consists essentially of said at least one monoester and said additives.

4. The engine lubricant of claim 1, wherein the engine lubricant comprises at least 25 wt % and up to 50 wt % of said at least one monoester.

5. The engine lubricant of claim 1, wherein the engine lubricant comprises lubricant components selected from API Groups III, III+, IV, IV+ and V and mixtures of two or more thereof.

6. The engine lubricant of claim 5, wherein the engine lubricant essentially of said at least one monoester, said additives and at least one API Group V lubricant.

7. The engine lubricant of claim 6, wherein the API Group V lubricant is an ester other than said at least one monoester.

8. The engine lubricant of claim 1, wherein said at least one monoester, or mixture of said monoesters if more than one is present, has a non-polarity index of at least 90.

9. The engine lubricant of claim 1, wherein said at least one monoester, or mixture of said monoesters if more than one is present, has a pour point of not more than −30° C.

10. The engine lubricant of claim 1, wherein said at least one monoester, or mixture of said monoesters if more than one is present, has a kinematic viscosity at 100° C. of not more than 3.0 cSt and/or a viscosity index of at least 140 and/or a pour point of not more than −35° C. and/or a Noack evaporation loss of not more than 14.0 wt %.

11. The engine lubricant of claim 1, wherein said alcohol comprises an alcohol branched at the β position on the main carbon chain and which contains 20 carbon atoms.

12. The engine lubricant of claim 1, wherein said acid is pentanoic acid and/or heptanoic acid.

13. The engine lubricant of claim 1, wherein the engine lubricant comprises at least one diester, wherein said at least one diester, or mixture of said diesters if more than one is present, has a kinematic viscosity at 100° C. of not more than 3.3, a viscosity index of at least 130, a pour point of not more than −30° C. and a Noack evaporation loss of not more than 15 wt %.

14. The engine lubricant of claim 1, wherein the engine lubricant comprises not more than 15 wt % of said additives.

15. A method of lubricating a four-stroke engine comprising: lubricating an engine with an engine lubricant comprising at least 15 wt % of at least one monoester and not more than 20 wt % of additives;

wherein:

i) the at least one monoester comprises the reaction product of:

a) at least one $C_{16-36}$ saturated branched-chain aliphatic monohydric alcohol; and b) at least one $C_{5-10}$ saturated straight-chain aliphatic monocarboxylic acid; and ii) said at least one monoester, or mixture of said at least one monoesters if more than one is present, has a kinematic viscosity at 100° C. of not more than 3.3, a viscosity index of at least 130 and a Noack evaporation loss of not more than 15 wt %.

16. The engine lubricant of claim 1, wherein the at least one monoester comprises 2-octyldodecyl heptanoate.

17. An engine lubricant comprising lubricant components selected from API Groups III, III+, IV, IV+ and V and mixtures of two or more thereof, at least 15 wt % of at least one monoester, and not more than 20 wt % of additives;

wherein:

i) the at least one monoester comprises the reaction product of:

a) at least one $C_{16-36}$ saturated branched-chain aliphatic monohydric alcohol; and b) at least one $C_{5-10}$ saturated straight-chain aliphatic monocarboxylic acid; and ii) said at least one monoester, or mixture of said at least one monoesters if more than one is present, has a kinematic viscosity at 100° C. of not more than 3.3, a viscosity index of at least 130 and a Noack evaporation loss of not more than 15 wt %.

18. The engine lubricant of claim 17, wherein the engine lubricant is an SAE 0W engine lubricant.

19. The engine lubricant of claim 17, wherein the engine lubricant comprises up to 90 wt % of said at least one monoester.

20. The engine lubricant of claim 17, wherein the engine lubricant comprises at least 25 wt % and up to 50 wt % of said at least one monoester.

21. The engine lubricant of claim 17, wherein the engine lubricant consists essentially of said at least one monoester, said additives and at least one API Group V lubricant.

22. The engine lubricant of claim 21, wherein the API Group V lubricant is an ester other than said at least one monoester.

23. The engine lubricant of claim 17, wherein said at least one monoester, or mixture of said monoesters if more than one is present, has a non-polarity index of at least 90.

24. The engine lubricant of claim 17, wherein said at least one monoester, or mixture of said monoesters if more than one is present, has a pour point of not more than −30° C.

25. The engine lubricant of claim 17, wherein said at least one monoester, or mixture of said monoesters if more than one is present, has a kinematic viscosity at 100° C. of not more than 3.0 cSt and/or a viscosity index of at least 140 and/or a pour point of not more than −35° C. and/or a Noack evaporation loss of not more than 14.0 wt %.

26. The engine lubricant of claim 17, wherein said alcohol comprises an alcohol branched at the β position on the main carbon chain and which contains 20 carbon atoms.

27. The engine lubricant of claim 17, wherein said acid is pentanoic acid and/or heptanoic acid.

28. The engine lubricant of claim 17, wherein the engine lubricant comprises: at least one diester, wherein said at least one diester, or mixture of said diesters if more than one is present, has a kinematic viscosity at 100° C. of not more than 3.3, a viscosity index of at least 130, a pour point of not more than −30° C. and a Noack evaporation loss of not more than 15 wt %.

29. The engine lubricant of claim 17, wherein the engine lubricant comprises not more than 15 wt % of said additives.

30. The engine lubricant of claim 17, wherein the at least one monoester comprises 2-octyldodecyl heptanoate.

* * * * *